US008387790B2

(12) United States Patent
Conner et al.

(10) Patent No.: US 8,387,790 B2
(45) Date of Patent: Mar. 5, 2013

(54) HOLDER FOR A TELECOMMUNICATIONS DEVICE

(75) Inventors: Timothy Conner, Clarkston, MI (US); John Christopher Preuss, Northville, MI (US); Andrew Young, Rochester, MI (US); Samuel Mancuso, Troy, MI (US); Michael A. Bommarito, Sterling Heights, MI (US)

(73) Assignee: General Motors LLC, Detroit, MI (US)

( * ) Notice: Subject to any disclaimer, the term of this patent is extended or adjusted under 35 U.S.C. 154(b) by 28 days.

(21) Appl. No.: 12/945,469

(22) Filed: Nov. 12, 2010

(65) Prior Publication Data

US 2012/0118769 A1 May 17, 2012

(51) Int. Cl.
*B65D 85/00* (2006.01)
*B65B 5/00* (2006.01)

(52) U.S. Cl. ..... 206/320; 206/523

(58) Field of Classification Search ..... 206/320, 206/523, 592, 591, 488, 486; 379/454, 455; 53/467, 472, 476, 484
See application file for complete search history.

(56) References Cited

U.S. PATENT DOCUMENTS

| | | | | |
|---|---|---|---|---|
| 3,120,319 | A * | 2/1964 | Buddrus | 215/12.2 |
| 3,181,693 | A * | 5/1965 | Freistat | 206/523 |
| 3,905,511 | A * | 9/1975 | Groendal | 220/739 |
| 4,228,908 | A * | 10/1980 | Tweeton | 215/11.6 |
| 4,872,563 | A * | 10/1989 | Warder et al. | 53/471 |
| 4,934,534 | A * | 6/1990 | Wagner | 206/568 |
| 5,048,734 | A * | 9/1991 | Long | 224/148.3 |
| 5,752,687 | A | 5/1998 | Lynch | |
| 5,791,460 | A | 8/1998 | Fitzgerald et al. | |
| 5,863,089 | A | 1/1999 | Ignarra et al. | |
| 6,039,207 | A * | 3/2000 | Adamek | 220/739 |
| 6,092,776 | A | 7/2000 | You | |
| 6,123,198 | A * | 9/2000 | Pflueger et al. | 206/581 |
| 6,185,302 | B1 | 2/2001 | Rytkönen et al. | |
| 6,246,766 | B1 | 6/2001 | Walsh | |
| 6,396,925 | B1 | 5/2002 | Close | |
| 6,604,649 | B1 * | 8/2003 | Campi | 220/739 |
| 6,657,214 | B1 * | 12/2003 | Foegelle et al. | 250/506.1 |
| 6,832,745 | B2 | 12/2004 | Lindsay | |
| 7,000,774 | B2 * | 2/2006 | Bryant | 206/769 |
| 7,099,466 | B2 | 8/2006 | Walsh | |
| 7,104,398 | B1 * | 9/2006 | Wisecarver | 206/316.3 |
| 7,494,015 | B2 * | 2/2009 | Bacon et al. | 206/778 |
| 7,668,309 | B2 | 2/2010 | Wilcox et al. | |

(Continued)

FOREIGN PATENT DOCUMENTS

WO WO 97/42057 11/1997

*Primary Examiner* — Steven A. Reynolds
(74) *Attorney, Agent, or Firm* — Dierker & Associates, P.C.

(57) ABSTRACT

A holder for a telecommunications device includes a container including a side wall connected to a base. Together the side wall and base define a cavity. Side wall defines an opening of the container at an end of the side wall distal to the base. A resilient insert is disposed inside the cavity. The insert includes a bottom portion that abuts the base and a feature for releasably retaining the device inside the container. A lid is in selective locking engagement with the side wall's distal end. When in locking engagement, the lid encloses the opening of the container to retain the device inside the holder, and to muffle a sound and/or a vibration produced by the device. A locking mechanism is operatively attached to the container and/or the lid, and holds the lid and the container together when the lid is in locking engagement with the distal end.

17 Claims, 4 Drawing Sheets

U.S. PATENT DOCUMENTS

| | | | | |
|---|---|---|---|---|
| 7,878,326 | B2 * | 2/2011 | Andre et al. | 206/320 |
| 2002/0094079 | A1 | 7/2002 | Edwards | |
| 2004/0086112 | A1 | 5/2004 | Hilger et al. | |
| 2007/0151899 | A1 * | 7/2007 | Chun | 206/775 |
| 2009/0146862 | A1 * | 6/2009 | Malone | 342/1 |
| 2009/0308993 | A1 | 12/2009 | Chang | |
| 2009/0326707 | A1 * | 12/2009 | Mattila | 700/216 |
| 2010/0294675 | A1 * | 11/2010 | Mangano | 206/5 |
| 2011/0011760 | A1 * | 1/2011 | Habersetzer | 206/320 |
| 2011/0100847 | A1 * | 5/2011 | Ruth | 206/320 |
| 2012/0055824 | A1 * | 3/2012 | Nash | 206/320 |

* cited by examiner

HOLDER FOR A TELECOMMUNICATIONS DEVICE

TECHNICAL FIELD

The present disclosure relates generally to holders for telecommunications devices.

BACKGROUND

Cellular phones, smart phones, and other telecommunications devices may be used as a way of establishing communications between two or more parties. These mobile devices are often carried by the owner and/or the possessor of the device, even when he/she is inside a mobile vehicle, such as a car. It may, in some instances, be desirable to have a place to stow the mobile device inside the vehicle so that the device interface(s) are not immediately accessible to the owner and/or possessor while he/she is operating the vehicle.

SUMMARY

A holder for a telecommunications device includes a container including a side wall connected to a base. The side wall and the base together define a cavity inside the container, and the side wall further defines an opening of the container at an end of the side wall distal to the base. The holder further includes a resilient insert disposed inside the cavity, where the insert includes a bottom portion that abuts the base of the container and a feature for releasably retaining the device inside the container. A lid is in selective locking engagement with the distal end of the side wall such that, when the lid is in locking engagement with the distal end, the lid encloses the opening of the container to i) retain the telecommunications device inside the holder, and ii) muffle a sound and/or a vibration produced by the telecommunications device. The holder also includes a locking mechanism operatively attached to the container and/or the lid, where the locking mechanism is configured to hold the lid and the container together when the lid is in locking engagement with the distal end of the side wall.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
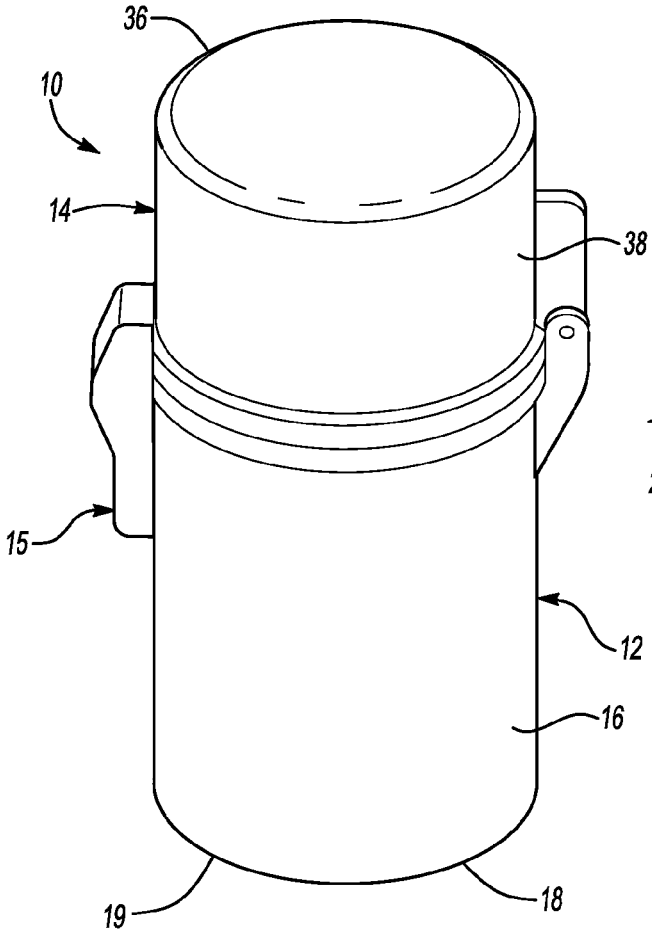
FIG. 1 is a front perspective view of an example of a holder when the holder is in a closed position.

Examples of the holder as disclosed herein may be used to isolate a mobile telecommunications device from the owner and/or possessor of the device when the owner and/or possessor and the mobile telecommunications device are inside a mobile vehicle, such as a car, truck, etc. Isolation of the device inside the holder enables the owner and/or possessor of the device, who may then-currently be operating the vehicle, to focus his/her attention on the road rather than on the device. In an example, the holder is designed to muffle sounds and/or vibrations that may emanate from the device (e.g., upon receiving a voice call, a text message, an e-mail, a post on a social networking page, etc.). In an example, the holder is also constructed with a locking mechanism that, when actuated, retains the device inside the holder. The use of the locking feature will potentially deter the owner and/or possessor of the device from attempting to answer an incoming call, message, or the like while he/she is driving.

Several examples of the holder will now be described in conjunction with the figures. It is to be understood that the holder in these examples is portable, and fits inside a vehicle cup holder. Thus, the size and shape of the holder disclosed herein is chosen so that at least a portion of the holder may be placed inside any standard vehicle cup holder. In one example, the holder has a cylindrical shape, has a diameter ranging from about 7 cm to about 8 cm, and has a height ranging from about 15 cm to about 15.5 cm. In another example, the holder has a diameter of about 7.3 cm and a height of about 15.2 cm. In one example, the holder has a uniform diameter throughout its height. In another example, the holder may be tapered along at least a portion of its height, where the extent of the taper is such that the mobile device still fits inside the holder. In this example, the bottom portion of the holder may have a diameter that is smaller than the diameter of the top portion of the holder, or the bottom and top portions may have respective diameters that are smaller than the diameter of a position somewhere between the bottom and top portions.

The holder is generally formed from a light-weight material, which is desirable in portable applications. In one example, the holder is also desirably formed from a material that tends to dampen sound. One example of a material that may be used for the holder is plastic, an example of which includes acrylonitrile butadiene styrene (ABS). Other examples of materials that may also or otherwise be used include fiberglass, composite materials, metal alloys (particularly those that are light-weight for purposes of portability, although in some instances other heavier metal alloys may be used), and/or combinations thereof.

It is to be understood that the holder may also be designed to fit inside any pre-existing opening inside the mobile vehicle. In instances where the mobile vehicle is a car or a truck, some examples of pre-existing openings include a vehicle door storage pocket, a tray formed in a center console of the car, an ash tray, and/or the like. Furthermore, the holder may be designed to fit into any pre-existing opening inside any type of mobile vehicle (examples of which include automobiles (i.e., cars), boats, airplanes, or the like). In an example, the holder may have a circular shape (formed by e.g., a single, continuous side wall 16 as described below), may have any shape formed from the connection of two opposed sides (e.g., a quasi pear shape formed from two integral or joined side walls 16), a triangular shape (formed from, e.g., three side walls 16), a quadrilateral shape (formed from, e.g., four side walls 16), as well as any shape formed from e.g., five or more side walls 16. In one example, the shape of the holder is dictated by the opening for which it is designed.

One example of a holder 10 is shown in FIG. 1. In its simplest form, the holder 10 includes a container 12, a lid 14, and a locking mechanism 15 for temporarily locking the lid 14 to the container 12. In this example, the container 12 has a cylindrical shape formed by a single, continuous side wall 16. The side wall 16 is connected to a base 18, which functions, in part, as a support for the holder 10.

The base 18 may be integrally formed with the side wall 16, or may be a separate piece that is secured to the side wall 16. In an example, the side wall 16 is formed integrally with the base 18 such that the side wall 16 and base 18 are formed of the same piece of material, and the side wall 16 blends into the base 18. In this example, the transition point 19 between the side wall 16 and the base 18 may have a smooth, and in some instances, rounded edge (i.e., an edge that has a radius). In this example, the base 18 and side wall 16 may be formed using any suitable molding technique (e.g., liquid molding processes for plastics) and/or any suitable manufacturing process for forming metal such as, e.g., a press forming process, a vacuum forming process, and/or the like. In another example, the side wall 16 is a separate piece that is physically connected to the base 18 using any suitable mechanical connector (e.g., via a latch, a bolt, a screw, etc.) or using any other suitable connecting means (e.g., via glue, welding, soldering, etc.). In this latter example, the transition point 19 formed between the side wall 16 and the base 18 may have an acute edge (i.e., an edge that is distinct and linearly angular, e.g., angled at 90° or less) or a rounded edge (i.e., an edge that has a radius, as mentioned above). When separate pieces are utilized, the method of connecting the side wall 16 to the base 18 may be chosen, for example, to maintain and/or improve a sound and/or vibration barrier between the inside and the outside of the holder 10. In an example, the connection between the side wall 16 and the base 18 is such that there are practically no gaps formed between the two pieces.

Figure 2:
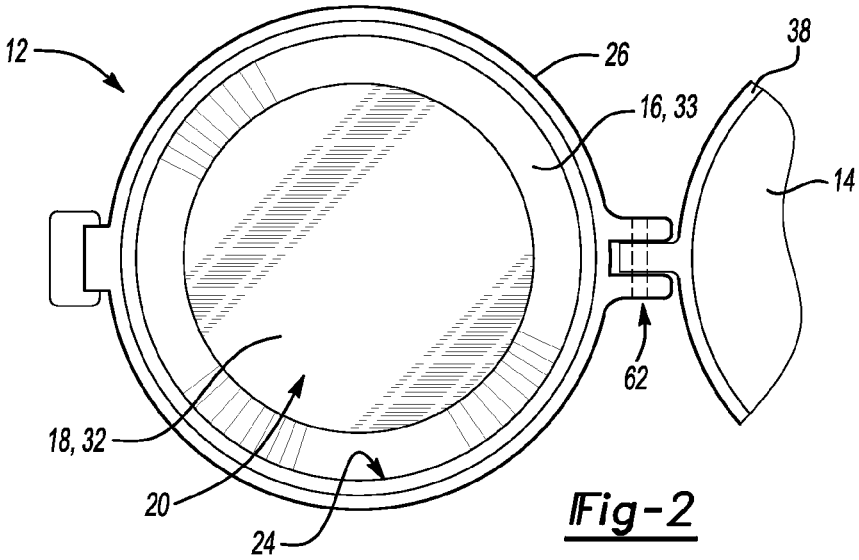
FIG. 2 is a cut-away top view of an example of the holder depicted in FIG. 1 when the holder is in an open position.

Referring now to FIG. 2, the side wall 16 and the base 18 together define a cavity 20 inside the container 12. In one example, the cavity 20 is hollow. As will be described in further detail below, the cavity 20 is configured to receive an insert 22 therein (shown in FIGS. 3 and 4). The insert 22 is constructed to receive and retain a mobile telecommunications device 100 (shown in FIGS. 4 and 9A through 9C) in the holder 10.

The side wall 16 also defines an opening 24 of the container 12 at an end 26 of the side wall 16 that is distal to the base 18. When the holder 10 is assembled, the insert 22 is disposed inside the container 12 through the opening 24.

As previously mentioned, the holder 10 may have a shape formed by a single continuous wall (such as, e.g., a cylindrical shape), may have any shape formed from the connection of two opposed sides (e.g., a pear shape), a triangular shape, a quadrilateral shape, as well as any shape having five or more sides. Accordingly, in an example, the side wall 16 may be a single, continuous wall that forms a cylindrical shape, an oval shape, and/or the like. In another example, the side wall 16 may be two or more walls joined together to form a holder 10 having another shape. For instance, the side wall 16 may include three adjoining walls to form a holder having a triangular shape. In another instance, the side wall 16 may include four adjoining walls to form a holder having a square or rectangular shape.

Figure 3:
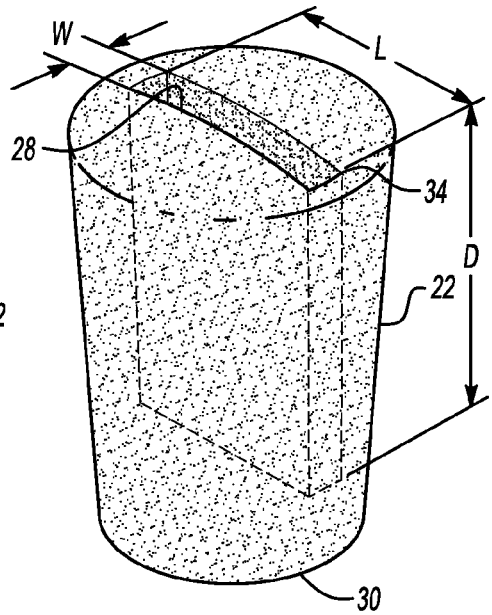
FIG. 3 is a perspective view of an example of an insert that may be disposed inside the container shown in FIG. 2.

An example of the insert 22 is schematically depicted in FIG. 3. In one example, the insert 22 includes a bottom portion 30 that abuts an inner surface 32 of the base 18 of the container 12 (shown in FIG. 2) when the insert 22 is disposed inside the cavity 20. In one example, the fit between the insert 22 and the inner surface 33 of the side wall 16 may be a contact fit, or a gap less than 0.5 mm could exist between the insert 22 and the inner surface 33 of the side wall 16.

The insert 22 further includes a feature 28 that releasably retains the mobile device 100 inside the holder 10 when the device 100 is disposed therein. In an example, the feature 28 is a slot defined in the insert 22, where the slot has a length L, width W, and depth D that enables the mobile device 100 to snuggly fit inside the feature 28. As used herein, the term "snuggly" refers to a relatively secure fit when the device 100 is at least partially disposed inside the feature 28 so that the device 100 does not move around in response to movement of the holder 10. In some instances, the snug/secure fit means that each side of the mobile device 100 will contact a respective side of the feature 28 when inserted therein. In other instances, the snug/secure fit means that at least one side of the mobile device 100 will contact a side of the feature 28 when inserted therein. Further, the mobile device 100 is considered to be snuggly fit inside the feature 28 when there is enough retention force to hold the device 100 inside the feature 28 when the holder 10 is turned up-side-down. In each example, the snug fit enables the holder 10 to securely retain the device 100, and enables the device 100 to be removed with a small amount of effort (such as by a pull or tug from a human hand without additional equipment, such as, for example, using the same amount of force that is required to lift a coffee mug).

The insert 22 is shown in FIG. 3 having a tapered body along its height. In this example, an inner surface 33 of the side wall 16 may also be tapered along its height, where the taper of the insert 22 conforms to the taper of the inner surface 33. The insert 22 may, in another example, have a non-tapered body along its height (i.e., uniform diameter throughout its height). In this other example, the inner surface 33 of the side wall 16 may also be non-tapered along its height so that the non-tapered body of the insert 22 conforms to the non-tapered inner surface 33.

In an example, the feature 28 (as shown in FIG. 3) is a rectangular-shaped slot, and includes sharp corners 34 (e.g., right angled corners, or some other desired angled corners). In another example, the feature 28 is a rectangular-shaped slot, and includes rounded corners (not shown in FIG. 3). In yet another example, the feature 28 may include a combination of sharp and rounded corners. It is to be understood, however, that the feature 28 may be any shaped slot that will suitably receive and retain the device 100 inside the holder 10. The other shape may, for instance, be any shape other than a rectangle, some examples of which include ovals, various four-sided shapes or quadrilaterals, circles, etc.

In some instances, the feature 28 may include smaller slots, such as those that may be used to grab (via, e.g., the user's fingers) the device 100 when inserted in the feature 28 without displacing the insert 22 from within the container 12. For example, these smaller slots may be respective finger holes that connect to the feature 28 along either side of the length L of the feature 28.

In one example, the feature 28 is about the size of the largest known mobile telecommunications device, such as, e.g., the Motorola DROID or the Apple iPHONE®. As such, in an example, the feature 28 ranges from about 5.5 cm to about 6.5 cm in length L, from about 1 cm to about 1.5 cm in width W, and from about 11 cm to about 12 cm in depth D. Due, at least in part, to the flexible nature of the insert 22 material (which is described in detail below), the feature's tolerance for fit ranges from about 1 mm to about 2 mm larger than the actual size of the feature 28. The depth D of the slot 28 may, in an example, be chosen to be smaller (up to, e.g., about 4 cm shorter) than the total length of the largest known mobile device 100. In this example, the top of the device 100 may extend above the container 12 and into the lid 14 when the lid 14 is closed (as described below). In instances where the depth D of the slot 28 is the same as the length of the largest known device 100, then the entire device 100 may be retained in the container 12, and none of the device 100 extends into the lid 14. It is to be understood that the dimensions that the mobile device 100 does or does not extend into the lid 14 depend, at least in part, on the size of the device 100 and how far the device 100 is pushed into the slot 28. It is possible that the device 100 is partially pushed into the slot 28, even though the depth D of the slot 28 is such that the entire slot 28 could retain the whole device 100. In this case, the top of the device 100 would extend into the lid 14.

In an example, the insert 22 is formed from a resilient material, i.e., any material that flexes when the mobile device 100 is placed inside the feature 28. It is to be understood that the resilient material from which the insert 22 is made enables the insert 22 to receive, via the feature 28, any mobile telecommunications device (such as the device 100, for instance) having any size and shape. In other words, the resilient material enables the holder 10 to retain any currently-known mobile communications device 100, and thus the holder 10 may be universal to all mobile telecommunications devices that are currently available. In an example, the insert 22 is formed from a foam that is conformable to the shape and size of the mobile device 100 when at least a portion of the mobile device 100 is placed inside the feature 28. It is desirable that the material selected for the insert 22 is flexible with some elasticity, and does not scratch or otherwise deleteriously affect the mobile device 100. Examples of foams that may be used for the insert 22 include polyurethane foams and polyethylene foams.

The insert 22 may be made, for example, by cutting the insert 22 from a large piece of material according to the shape and size of the interior the container 12 within which the insert 22 will ultimately be disposed. The insert 22 (whether formed of one or multiple pieces) should fit inside the container 12 according to a true fit so that the insert 22, which will ultimately retain the mobile device 100 via the feature 28, does not move around inside the container 12 and thus inside the holder 10. This lack of movement contributes to the muffling of the sound and/or vibration that may emanate from the device 100 (which is described further below), and also serves to protect the device 100 from any damage that may occur as a result of a loose fit. In an example, the insert 22 may be cut using a knife, blade, or any other suitable cutting tool.

The feature 28 that is formed in the insert 22 may also be formed via a suitable cutting technique. For instance, the insert 22 may be cut using, e.g., a knife, blade, or the like, and then the cut portion of the insert 22 is removed to form the slot 28. The feature 28 may, in another example, be formed in the insert 22 via a machining process, such as via die cutting.

In an example, a single insert 22 may be provided with the holder 10, where the insert 22 includes the feature 28 defined therein that is universal to all known mobile telecommunications devices 100. In another example, a user may be able to select the holder 10 with a pre-cut insert 22 that fits his/her particular mobile device 100. In still another example, the holder 10 may be provided with any number of different inserts 22, each of the inserts 22 having a feature 28 defined therein with different or varying dimensions from each of the other inserts. In this example, a consumer may select which insert 22 he/she wants to dispose inside the container 12 at any given time. This example may be beneficial for those consumers that have more than one mobile device 100, where each device 100 has a different size, and/or will be sharing the holder 10 with other user(s) who have different mobile device(s). In yet another example, the holder 10 may come with one or more inserts 22 that do not have a feature 28 already defined therein. In this case, the holder 10 may come with or recommend suitable tooling so that the consumer can define the feature 28 inside the insert 22 himself/herself.

Figure 4:
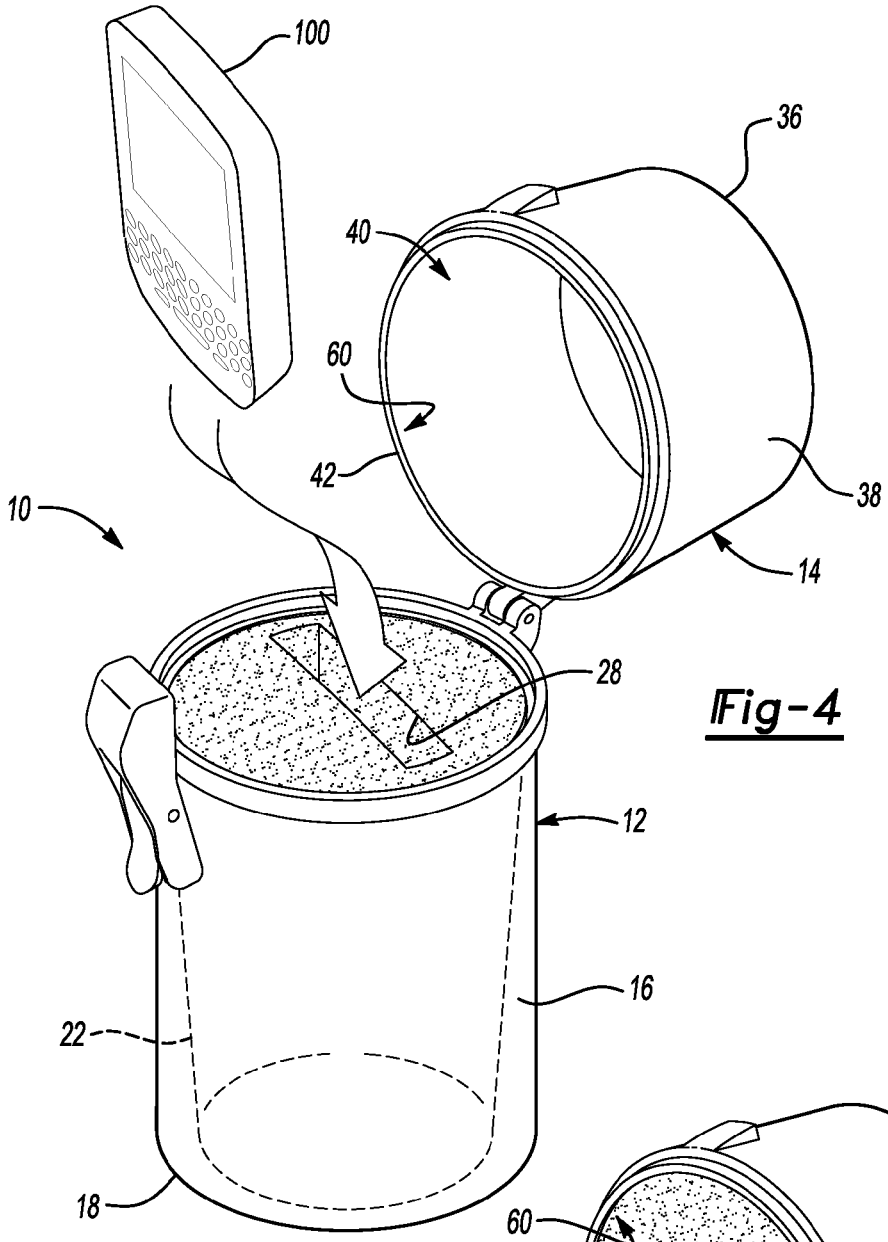
FIG. 4 is a perspective view of the example of the holder shown in FIG. 1 when the holder is in an open position and when an insert is inserted therein.

Referring now to FIGS. 1 and 4, the lid 14 is designed to be disposed on the container 12. The lid 14 may also, in some examples, receive a portion of the mobile device 100 (if, e.g., the mobile device 100 is larger than the feature 28 defined in the insert 22). When the lid 14 is completely disposed on the container 12 (i.e., the opening 24 is completely covered by the lid 14), the holder 10 is considered to be in a "closed position." The holder 100 in the closed position is shown in FIG. 1. However, when the opening 24 is at least partially uncovered by the lid 14 (e.g., the lid 14 is completely or partially removed from the container 12), the holder 10 is considered to be in an "open position." An example of the holder 10 in the open position is shown in FIG. 4.

Still referring to FIGS. 1 and 4, the lid 14 includes a top 36, a side wall 38 connected to the top 36, and a lid cavity 40 defined by the lid side wall 38 and the top 36. It is to be understood that the lid 14 may have any size and shape as desired. In these examples, the lid 14 is sized and/or shaped such that it can receive a portion of the mobile device 100 (if any portion of the device 100 is protruding beyond the feature 28 of the insert 22) when the lid 14 is disposed on the container 12. The lid 14 further includes an end 42 that is distal to the top 36, where the periphery of the end 42 is about the same, if not exactly the same size as the periphery of the end 26 of the side wall 16 of the container 12. It is to be understood that the same/about the same respective sizes of the ends 26, 42 enables closure of the holder 10 such that the lid 14 sealingly encloses the opening 24 of the container 12. The term "sealingly", as used herein, refers to the enclosure of the opening 24 such that practically no gaps exist between the lid 14 and the container 12 that would provide a path for the movement of sound and/or vibration waves from inside the holder 10 to outside of the holder 10. It is to be understood that practically no gaps include zero gaps that are formed between the lid 14 and the container 12, or a minimal number of gaps, where the size of each gap is so small that such gaps are considered to be insignificant with respect to forming at least a partial sound and/or vibration barrier. In one example, when the lid 14 sealingly encloses the opening 24 of the container 12, the enclosure is air tight. When the holder 10 is in the closed position, the mobile device 100 is not visible through any part of the holder 10.

Furthermore, the sealing enclosure of the opening 24, as well as the resilient material used to form the insert 22, creates at least a partial barrier for sound and/or vibration between the inside and the outside of the holder 10. In other words, any sound and/or vibration that emanates from the mobile device 100 is muffled, to some extent, so that the owner and/or possessor of the device 100 may not notice the sounds and/or vibrations of the device 100 while operating the vehicle. As used herein, the term "muffle", when used in terms of sound, refers to the damping of sound waves such that the audible level of the sound is less than when the sound is not damped. Further, the term "muffle", when used in terms of vibration, refers to the damping of vibration energy such that the level of vibration is less than when the vibration is not damped. In an example, the muffling may include damping the sound and/or vibration to a level that is at least about 30% of the sound and/or vibration when the device 100 is not disposed in the holder 10. In another example, the muffling may include damping the sound and/or vibration to a level that is at least about half (i.e., at least about 50%) of the sound and/or vibration when the device 100 is not disposed in the holder 10. In an example, if the device 100 emanates sound at 12 decibels when outside of the holder 10, then the holder 10 (in the closed position) may muffle the device 100 to a sound level of about 6 decibels.

It is to be understood that muffling of the sound and/or vibration, as perceived by the vehicle operator, may be affected by the volume level on the mobile device 100 and/or various environmental conditions inside and/or outside of the vehicle. Thus, in some instances, the sound and/or vibration is further muffled (beyond the actual damping resulting from the holder 10) or even completely eliminated relative to the vehicle operator. For instance, any muffled sound and/or vibration emanating from the device 100 and through the holder 10 may be further muffled by noisy road conditions (e.g., driving through a construction zone), weather conditions (e.g., driving through a rain storm), radio settings (e.g., if the sound level of the radio is loud), other interior conditions (e.g., the blowing of the HVAC system, windows in an open position, convertible or T-tops open, etc.) and/or the like. In some cases, the muffling of the sound and/or vibration may appear to be further muffled based on the hearing level of the vehicle operator. In this case, the sound may appear to be completely damped if the vehicle operator has poor hearing, the vibration may appear to be completely damped if the vehicle is traveling along a bumpy road, and/or the like. In some instances, the holder 10 itself may completely dampen the sound and/or vibration.

Figure 5:
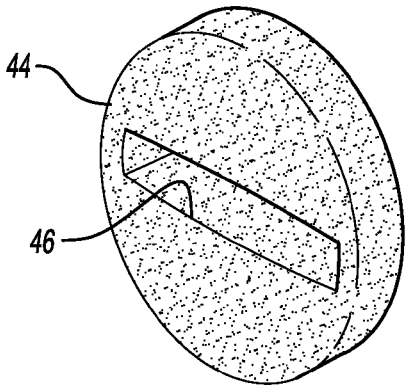
FIG. 5 is a perspective view of an example of an insert that may be disposed inside a lid of the holder.
Figure 6:
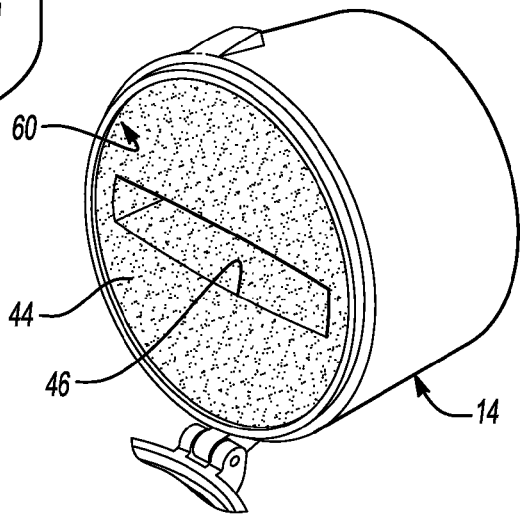
FIG. 6 is a perspective view of an example of a lid of the holder including an insert disposed therein.

In one example, the lid 14 may include a lid insert 44, which is schematically shown in FIG. 5. In this example, the lid insert 44 may be disposed inside the cavity 40 of the lid 14, as shown in FIG. 6. The lid insert 44 may be formed from a resilient material, such as the material described above for the insert 22 for the container 12. The lid insert 44 may be sized and shaped so that the insert 44 contact fits inside the lid cavity 40 (or has a slight gap, e.g., equal to or less than 0.5 mm), and may further include a lid feature 46 defined in the lid insert 44 that aligns with the feature 28 defined in the insert 22. This lid feature 46 is configured to receive a portion of the mobile device 100 when the lid 14 is disposed on the distal end 26 of the container 12 (i.e., when the holder 10 is in the closed position). Since the device 100 is retained by the feature 28, the lid feature 46 may provide a space for the portion of the device 100 that is not retained by the feature 28. In one example, the lid feature 46 may have a size and shape that is complementary to the feature 28. In another example, the lid feature 46 may have any size and shape that will suitably receive the protruding portion of the device 100.

In another example, the lid 14 does not include a lid insert. In this example, the device 100, when disposed inside the holder 10, is retained by the feature 28 defined in the insert 22 alone (i.e., there is no protruding portion of the device 100).

Figure 7:
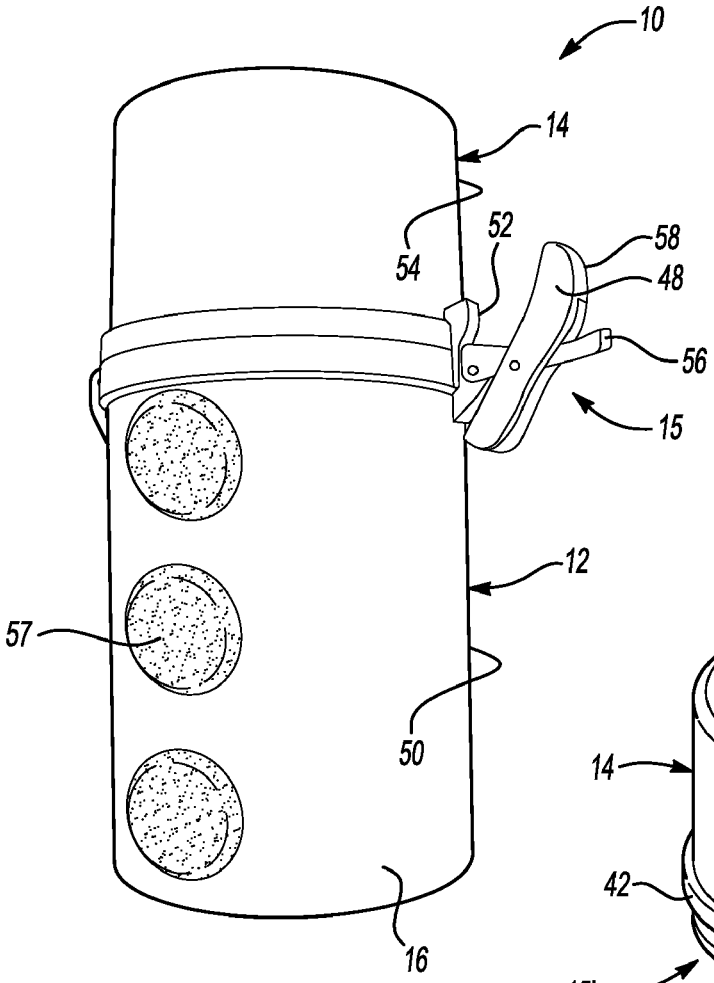
FIG. 7 is a back perspective view of an example of the holder including an example of a locking mechanism.

The locking mechanism 15 (as previously mentioned) holds the lid 14 and the container 12 together when the lid 14 is in locking engagement with the container 12. For instance, when the lid 14 is disposed on the distal end 26 of the side wall 16, the lid 14 encloses the opening 24 of the container 12 and sealingly retains the mobile device 100 inside the holder 10. One example of the locking mechanism 15 is shown in FIGS. 1 and 7. In this example, the locking mechanism 15 includes a latch 48 that is operatively connected to an outer surface 50 of the side wall 16 of the container 12, and a complementary receiver 52 that is operatively connected to, or formed on an outer surface 54 of the side wall 38 of the lid 14. It is to be understood that the latch 48 and receiver 52 may be arranged in an opposite manner, whereby the latch 48 may be operatively connected to the outer surface 54 of the lid side wall 38, and the receiver 52 may be operatively connected to, or formed on the outer surface 50 of the container side wall 16.

In an example, the latch 48 may include a lever 56 that may be used to actuate the latch 48 into and out of locking engagement with the receiver 52. The latch 48 may further include a retainer 58 that, when the lever 56 is in a locking position, captures or otherwise engages the complementary receiver 52 to sealingly enclose the opening 24 of the container 12 with the lid 14. When the lever 56 is in an unlocking position, however, the retainer 58 releases the receiver 52 to separate the lid 14 from the container 12, and thus open up the holder 10.

The latch 56 and the retainer 58 of the locking mechanism 15 shown in FIG. 7 may be situated at the respective ends 26 and 42 of the container 12 and the lid 14, or visa versa. As used herein, "at the end 26" or "at the end 42" refers to an area on the container 12 or the lid 14, respectively, that is or is proximate to, but may also extend away from an edge that defines the opening 24 of the container 12 and the opening 60 of the lid (shown in FIG. 4) (e.g. end portions).

In the embodiment depicted in FIG. 7, the holder 10 may further include a hinge 62 that is operatively attached to the lid 14 and to the container 12. The hinge 62 enables the lid 14 to move from a closed position (thus placing the holder 10 in the closed position) to an open position (thus placing the holder 10 in the open position), and visa versa. The hinge also enables movement of the lid 14 without the lid being physically detached from the holder 10. It is to be understood that any suitable hinge may be used. Further, it is to be understood that a living hinge (not shown) may be used, with the lid 14 and the container 12 being integrally formed from the same material (e.g., a polymeric or other suitably flexible material) with a living hinge therebetween.

It is to be understood that the holder 10 may include a locking mechanism 15 without a hinge. In this case, the lid 14 may be physically detached from the container 12 when the lid 14 is not locking engagement with the container 12.

Figure 8:
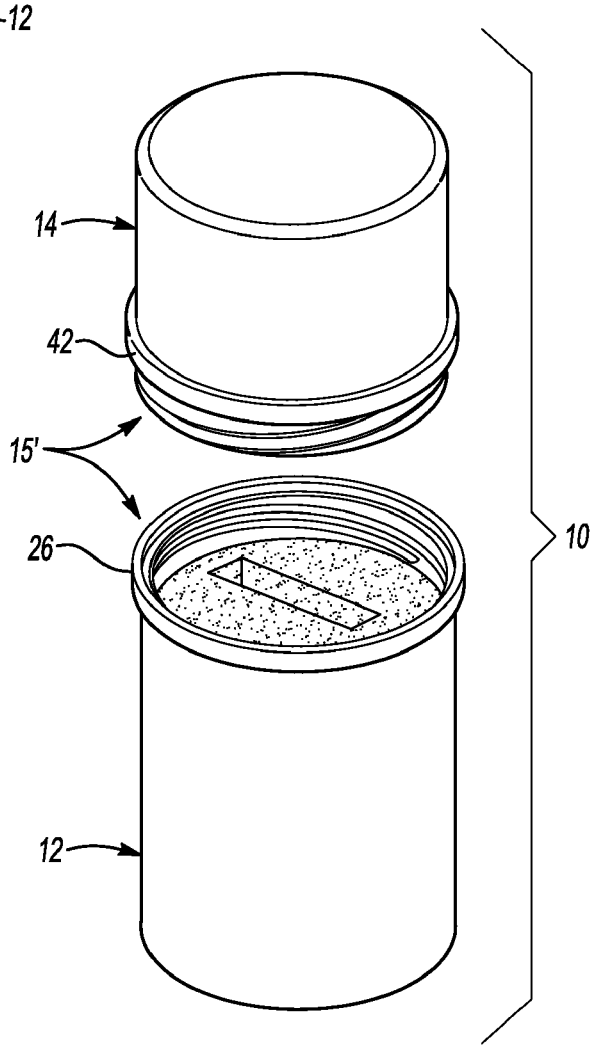
FIG. 8 is a perspective view of the holder including another example of a locking mechanism.

Another example of the locking mechanism is schematically shown in FIG. 8. In this example, the locking mechanism 15' includes mating threads on the end 26 of the container side wall 16 and on the end 42 of the lid side wall 38. In this example, upon placing the mobile device 100 inside the holder 10, the lid 14 may be threadingly engaged with the container 12 upon rotational movement of the lid 14 relative to the container 12. Such threading engagement encloses the opening 24 of the container 12 with the lid 14.

Other examples of locking mechanisms may also be used, some examples of which may include fasteners, clamps, a snap-top arrangement where the lid 14 snaps onto the container 12, and the two 12, 14 are connected together via a press or interference fit, and/or the like.

Also disclosed herein is a method for retaining a mobile communications device 100 inside the holder 10 while operating a vehicle. If the insert 22 is not disposed in the container 12 and/or the insert 44 is not disposed in the lid 14, the method may begin with inserting the respective inserts 22, 44.

Figures 9A, 9B, 9C:
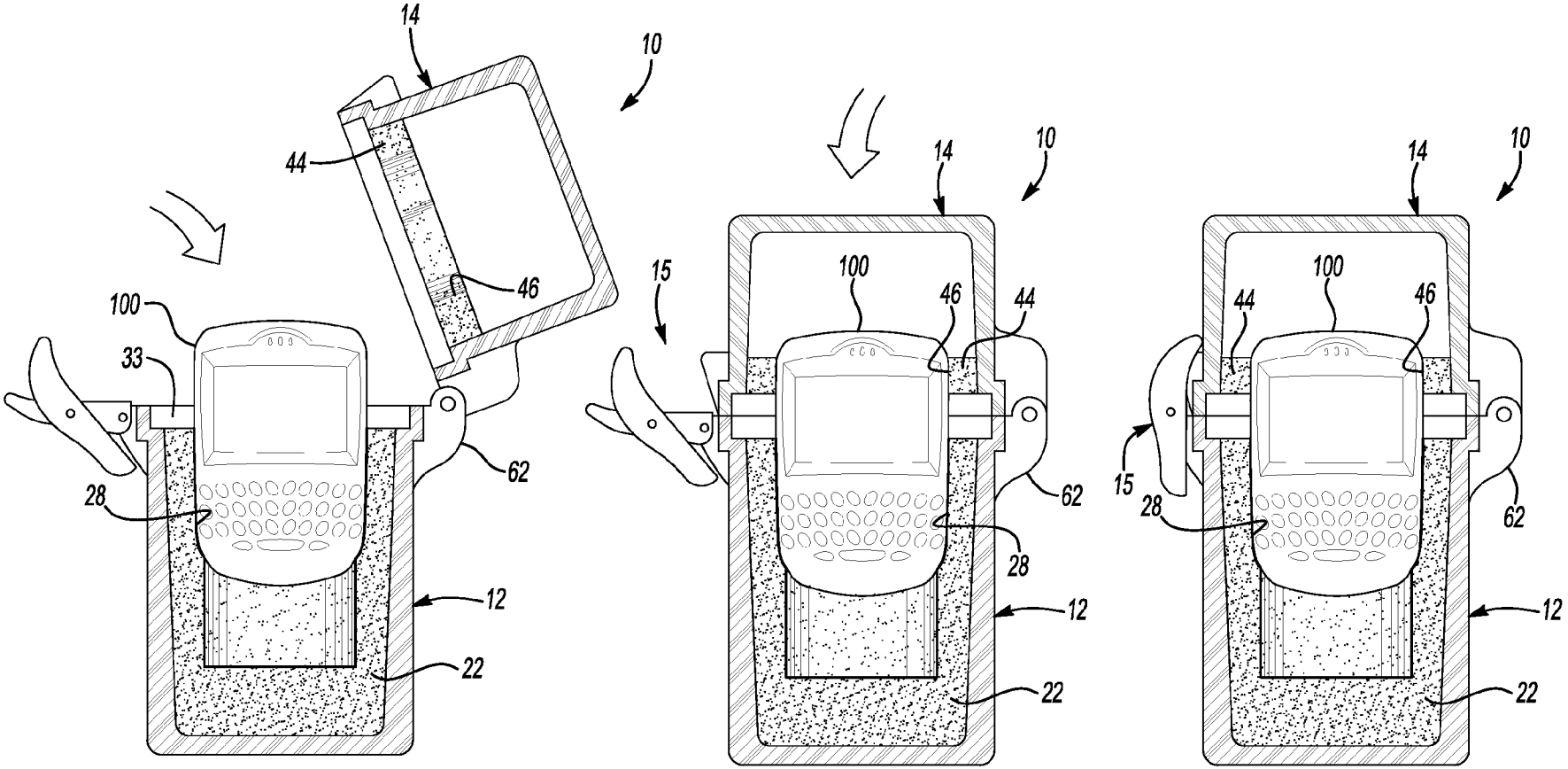
FIGS. 9A through 9C together semi-schematically depict an example of a method of retaining a telecommunications device inside a holder.

An example of the method includes placing the device 100 inside the holder 10 (FIG. 9A). Placing of the device 100 may be accomplished by aligning the device 100 with the feature 28 defined in the insert 22 in the container 12, and then sliding the device 100 into the feature 28. In some instances, the sliding may require the application of some pressure (such as by the push of a human hand) to push the device 100 into the feature 28. Upon sliding the device 100 into the feature 28, the resilient material from which the insert 22 is made conforms to the size and shape of the device 100 so that the device 100 is snuggly fit inside the feature 28 and thus inside the container 12.

Then, the lid 14 is disposed on the end 26 of the container side wall 16 to enclose the opening 24 of the container 12 (FIG. 9B). In the example where the holder 10 includes a hinge 62, the lid may be disposed on the container 12 via pivotal motion along a rotational axis defined by the hinge 62 relative to its position on the container 12 and the lid 14. The lid 14 is pivoted about the hinge 62 until the lid 14 completely covers the opening 24, and is lockingly engaged with the container 12.

In other examples, where the lid 14 is physically detached from the container 12 when the holder 10 is in an open position (e.g., when the holder 10 does not include a hinge 62), the lid may be disposed on the container 12 by physically picking the lid 14 up and placing it over the opening 24 of the container 12 and engaging the lid 14 therewith.

In instances where the lid 14 includes a lid insert 44, when the lid 14 is disposed on the container 12, a protruding portion (if any) of the device 100 is received inside the lid feature 46. However, in instances where the lid 14 does not include a lid insert 44, then the protruding portion (if any) of the device 100 is received inside the cavity 40 of the lid 14.

Once the lid 14 has been disposed on the container 12, the method further includes locking the device 100 inside the holder 10 by actuating the locking mechanism 15, 15' (FIG. 9C). In the example where the locking mechanism 15 is a latch 48, the locking of the holder 10 involves actuating the lever 56 of the latch 48 so that the retainer 58 engages the receiver 52. In the example where the locking mechanism 15' includes mating threads, the locking of the holder 10 involves rotating the lid 14 with respect to the container 12 so that the lid 14 and the container 12 threadingly engage.

After the device 100 has been locked inside the holder 10, the holder 10 may be placed into a desired spot, such as a cup holder of the vehicle. The holder 10 may further be releasably joined to a desired area in the vehicle, e.g., by mating hooks and loops 57 (an example of which is commercially available as VELCRO brand fasteners). The device 100 may be locked or otherwise retained in the holder 10 until the owner and/or possessor of the device 100 decides to remove the device 100 from the holder 10. When this occurs, the lid 14 may be removed from the container 12 by unlocking the locking mechanism 15, 15' (e.g., by detaching the retainer 58 from the receiver 52 of the latch 48, or by rotating the lid 14 relative to the container 12 in an opposite direction so as to undo the engagement of the mating threads). Once the lid 14 is removed, the device 100 may be removed from the feature 28.

While several examples have been described in detail, it will be apparent to those skilled in the art that the disclosed examples may be modified. Therefore, the foregoing description is to be considered non-limiting.

The invention claimed is:

1. A system, comprising:

a holder for a telecommunications device, the holder comprising:

a container including a side wall connected to a base, the side wall and the base together defining a cavity inside the container, wherein the side wall further defines an opening of the container at an end of the side wall distal to the base;

a resilient insert disposed inside the cavity, the insert including:

a bottom portion that abuts the base of the container; and a feature for releasably retaining a portion of the telecommunications device inside the container, the feature being any of pre-formed or pre-cut to a size and shape of the portion of the telecommunications device;

wherein the resilient insert conforms to the size and shape of the portion of the telecommunications device retained inside the feature;

a lid in selective locking engagement with the distal end of the side wall such that, when the lid is in locking engagement with the distal end, the lid encloses the opening of the container to i) retain the telecommunications device inside the holder, and ii) muffle any of a sound or a vibration produced by the telecommunications device, the lid including:

a top;

a lid side wall connected to the top;

a lid cavity defined by the lid side wall and the top; and a resilient lid insert disposed inside the lid cavity, the resilient lid insert i) including a lid feature that aligns with the feature defined in the insert disposed inside the cavity of the container, ii) having a size and shape to receive an other portion of the telecommunications device protruding from the container, iii) being any of pre-formed or pre-cut to the size and the shape of the other portion of the telecommunications device, and iv) conforming to the size and the shape of the other portion of the telecommunications device protruding from the container when the lid is in locking engagement with the distal end of the side wall of the container; and a locking mechanism operatively attached to any of the container or the lid, the locking mechanism configured to hold the lid and the container together when the lid is in locking engagement with the distal end of the side wall; and the telecommunications device disposed inside the holder.

2. The system as defined in claim 1 wherein the container is shaped and sized so that the container fits inside a vehicle cup holder.

3. The system as defined in claim 1 wherein the resilient insert is formed from a foam.

4. The system as defined in claim 1 wherein the feature is a slot defined in the insert, the slot having a length, width, and depth that enables the portion of the telecommunications device to snuggly fit inside the slot.

5. The system as defined in claim 4 wherein the slot is rectangularly-shaped, and includes sharp corners, rounded corners, or combinations thereof.

6. The system as defined in claim 1, further comprising a hinge operatively connected to the lid and to the container, the hinge enabling the lid to move from a closed position to an open position, and from an open position to a closed position, wherein the hinge enables the movement of the lid without the lid being physically detached from the holder.

7. The system as defined in claim 1 wherein the locking mechanism includes:

a latch operatively connected to the container side wall or the lid side wall; and a complementary receiver operatively connected to, or formed on the lid side wall or the container side wall;

wherein the latch is configured to engage the complementary receiver to sealingly enclose the opening of the container with the lid.

8. The system as defined in claim 1 wherein the locking mechanism includes mating threads on the distal end of the side wall and on the side wall of the lid, the mating threads configured for selective threading engagement to sealingly enclose the opening of the container with the lid.

9. The system as defined in claim 1 wherein the holder is portable.

10. A method of retaining a telecommunications device inside a holder while operating a vehicle, comprising:

placing a portion of the telecommunications device inside the holder, the holder including:

a container including a side wall connected to a base, the side wall and the base together defining a cavity inside the container, wherein the side wall further defines an opening of the container at an end of the side wall distal to the base;

a resilient insert disposed inside the cavity, the insert including:

a bottom portion that abuts the base of the container; and a feature for releasably retaining the portion of the telecommunications device inside the container, the feature being any of pre-formed or pre-cut to a size and shape of the portion of the telecommunications device;

a lid in selective locking engagement with the distal end of the side wall, the lid including:

a top;

a lid side wall connected to the top;

a lid cavity defined by the lid side wall and the top; and a resilient lid insert disposed inside the lid cavity, the resilient lid insert i) including a lid feature that aligns with the feature defined in the insert disposed inside the cavity of the container, ii) having a size and shape to receive an other portion of the telecommunications device protruding from the container, iii) being any of pre-formed or pre-cut to the size and the shape of the other portion of the telecommunications device, and iv) being configured to conform to the size and the shape of the other portion of the telecommunications device protruding from the container upon receiving the other portion of the telecommunications device when the lid is in locking engagement with the distal end of the side wall of the container; and a locking mechanism operatively attached to any of the container or the lid, and configured to hold the lid and the container together when the lid is in locking engagement with the distal end of the side wall;

disposing the lid on the distal end of the side wall to enclose the opening of the container; and locking the telecommunications device inside the holder by actuating the locking mechanism, the locking enclosing the opening of the container to i) retain the telecommunication device inside the holder, and ii) muffle any of a sound or a vibration produced by the telecommunications device.

11. The method as defined in claim 10 wherein the feature is a slot defined in the resilient insert, and wherein the placing of the portion of the telecommunications device inside the holder includes sliding the portion of the telecommunications into the slot.

12. The method as defined in claim 11 wherein the resilient insert is formed from a foam material, and wherein upon sliding the portion of the telecommunications device into the slot, the foam conforms to the size and shape of the portion of the telecommunications device so that the telecommunications device snuggly fits inside the slot.

13. The method as defined in claim 10, further comprising receiving the other portion of the telecommunications device inside the lid feature when the lid is in locking engagement with the distal end of the side wall.

14. The method as defined in claim 10 wherein the holder further includes a hinge operatively attached to the side wall of the container and to the lid side wall, and wherein the disposing of the lid on the end of the container includes pivoting the lid from an open position when the lid is not disposed on the container side wall to a closed position when the lid is disposed on the container side wall.

15. The method as defined in claim 10 wherein the locking mechanism includes a latch operatively connected to the container side wall or the lid side wall and a complementary receiver operatively connected to, or formed on the lid side wall or the container side wall, and wherein the actuating of the locking mechanism includes engaging the latch with the receiver when the lid is disposed on the side wall of the container.

16. The method as defined in claim 10 wherein the locking mechanism includes mating threads on the distal end of the side wall and on the side wall of the lid, the mating threads configured for selective threading engagement to sealingly enclose the opening of the container with the lid, and wherein the actuating of the locking mechanism includes rotating the lid with respect to the container so that the lid and the container threadingly engage such that the lid sealingly encloses the opening of the container.

17. The method as defined in claim 10, further comprising placing the holder inside a cup holder of the vehicle.

* * * * *